United States Patent [19]

Christian et al.

[11] Patent Number: 4,655,033

[45] Date of Patent: Apr. 7, 1987

[54] METHOD AND EQUIPMENT FOR MAKING STRANDED ROPES

[75] Inventors: Philip Christian, Norton; John M. Walton, Sprotbrough, both of England

[73] Assignee: Bridon plc, Doncaster, England

[21] Appl. No.: 825,142

[22] Filed: Jan. 31, 1986

[30] Foreign Application Priority Data

Feb. 1, 1985 [GB] United Kingdom ..... 8502557

[51] Int. Cl.[4] ..... D07B 3/00

[52] U.S. Cl. ..... 57/11; 57/3.5; 57/6; 57/9; 57/13; 57/314

[58] Field of Search ..... 57/3, 3.5, 6, 7, 9, 57/10, 11, 12, 13, 15, 311, 314

[56] References Cited

U.S. PATENT DOCUMENTS

| | | | |
|---|---|---|---|
| 2,342,342 | 2/1944 | Hotchkiss, Jr. et al. | 57/11 |
| 2,344,917 | 3/1944 | Hotchkiss, Jr. | 57/11 |
| 2,347,631 | 4/1944 | Hotchkiss, Jr. | 57/11 |
| 2,347,632 | 4/1944 | Hotchkiss, Jr. | 57/11 |
| 2,926,482 | 3/1960 | Hardesty | 57/11 |
| 2,967,390 | 1/1961 | McCormick | 57/11 |

*Primary Examiner*—John Petrakes

*Attorney, Agent, or Firm*—Trexler, Bushnell, Giangiorgi & Blackstone, Ltd.

[57] ABSTRACT

A stranded rope (12) of large size is made by assembling a plurality of strands (10) and a core (11) side-by-side along a track (13); securing the leading ends in a clamp (14); securing the trailing ends in spaced anchorages (17, 18); applying tension to the strands (10) and core (11); guiding the strands (10) intermediate the clamp (14) and anchorages (17, 18) into the closed rope array round the core (11) by means of a closing die (20) on a trolley (19); moving the trolley (19) from the clamp (14) to the anchorages (17, 18); rotating the clamp (14) progressively as the trolley (19) moves progressively; rotating the trailing ends of the strands (10) and core (11) progressively in the same direction as the clamp (14); securing all the strands (10) and the core (11) together adjacent the trailing ends; and releasing the tension from the strands and the core.

13 Claims, 10 Drawing Figures

METHOD AND EQUIPMENT FOR MAKING STRANDED ROPES

This invention relates to a method and equipment for making stranded ropes of large size, the expression "stranded ropes of large size" including large ropes formed by closing strands or ropes of appreciable overall diameter onto a core strand or rope, e.g., a cable-lay rope.

Growth of activity in exploration and extraction of mineral resources, both on land and offshore, has led to a demand for ever larger and stronger ropes.

Conventional manufacturing methods rely upon the use of expensive rotating "rope spinning" machinery, which has a finite limited capacity in terms of rope size and/or weight.

The object of the present invention is to provide a method and equipment for making stranded ropes of large size, particularly—but not exclusively—of steel wire.

According to one aspect of the present invention, a method of making stranded ropes comprises: assembling a plurality of strands (which expression includes ropes) and a core side-by-side; securing all the strands and the core together at one, leading end in the required closed rope array; securing all the strands and the core separately at the other trailing end, spaced apart and rotatable; applying tension to all the strands and to the core; guiding the strands intermediate the ends into the closed rope array round the core; moving the aforesaid guiding progressively from the leading end to the trailing end; rotating the leading end progressively as the aforesaid guiding moves progressively; rotating the trailing ends of the strands and the core progressively in the same direction as the leading end; securing all the strands and the core together adjacent the trailing end; and releasing the trailing ends of the strands and the core and the tension applied thereto.

Torque may be applied to the trailing ends of all the strands and the core by rotating them before rotation of the leading end commences, if it is necessary to restore twist in the strands and core after assembling them side-by-side. The trailing ends of the strands and the core may be rotated at a slightly different speed to the leading ends (either slightly faster or slightly slower), so as to increase the torsional stability of the stranded rope.

The individual strands (e.g., six) may be manufactured using conventional tubular or planetary stranding machinery, or other machinery or equipment appropriate to the size of strand, for example, equipment as described and claimed in UK Patent Application No. 8420383, the strands being cut to the required length and the ends terminated (with clamps, grips, welded eyes, or other fittings capable of withstanding substantial axial loads), a core strand of wire or fibre material is similarly prepared, and then assembled as described above with the strands guided into close array round the core strand, and subjected to the other steps of the above method.

Alternatively a plurality of ropes (e.g., six) manufactured using conventional machinery, or other machinery, or equipment as referred to in the preceding paragraph, may be assembled as described above with six (outer) ropes guided into a closed array around a core, which may be a rope, and subjected to the other steps of the above method.

The above method is particularly suitable for the spinning together of strands which are too large or rigid to be handled on a conventional closing machine. By this technique it is possible to spin together long-lay strands which could not be accommodated on normal closer bobbins without the risk of irrecoverable deformation. A further benefit of the method is that extremely long closing lays may be adopted with the following additional advantages:

(a) high tensile efficiency (low spinning loss)
(b) low stretch (high modulus) under load
(c) excellent torque balance under load
(d) the individual strands may be plastics sheathed prior to closing, without serious sheathing deformation occurring when the rope is tensioned.

According to another aspect of the present invention, equipment for making stranded ropes comprises: an elongate track; a clamp for securing a plurality of strands (which expression includes ropes) and a core in the required closed array at one, leading end of the track and rotatable about an axis parallel to the track; anchor means restrained at a distance along the track from the clamp and having rotatable tensioning spaced anchorages for trailing ends of strands extending along the track from the clamp, the anchor means also having radially equidistant from the strand anchorages a central rotatable tensioning ancorage for the trailing end of a core also extending along the track from the clamp; a trolley movable along the track between the clamp and the anchor means and carrying a forming die for closing the strands to the core in the required closed rope array, the forming die being disposed between a lay plate having strand guide apertures spaced radially equidistant from a core guide aperture, and a fairlead for leading off the formed rope; first drive means for moving the trolley along the track; second drive means for rotating the clamp at the leading end of the track with a predetermined relationship to movement of the trolley away from the leading end of the track; and third drive means for rotating the trailing ends of the strands and the core progressively in the same direction as the clamp at the leading end.

The combination of tension in the strands and the core, rotation of the clamped leading end of the closed array, and rotation of the trailing ends of the strands and the core enables the forming die to form the rope without undue stresses being induced as the forming die moves progressively with the trolley along the track away from the leading end, the lay length of the strands in the formed rope being determined by the ratio of rotation of the leading end to movement of the trolley along the track.

Sets of rollers are preferably provided at intervals along the track, aligned with their axes parallel to the track, to support the strands and core between the anchor means and the trolley and to support the formed rope between the trolley and the clamp at the leading end of the track.

The third drive means may be drivable at the same speed as the second drive means, to ensure no stresses are induced in the core, and the trailing ends of the strands may be so drivable in relation to the trailing ends of the core as to ensure no stresses are induced in the strands. Alternatively, the trailing ends of the strands and/or the core may be drivable at a slightly different speed from the clamp at the leading end (either slightly faster or slightly slower), so as to increase the tightness or stability of the stranded rope.

The third drive means is conveniently a motor mounted on top of an upright plate of the anchor means, with a pinion drivable by the motor in mesh with a gear rotatable with one of the strand anchorages, the other strand anchorages and the central anchorage for the core having similar gears drivable through idler pinions from the initially-driven gear.

Each strand tensioning anchorage may comprise an annular cylinder-and-piston unit for thrusting between the upright plate and a clamp on a strand extending through the units, and the core tensioning anchorage preferably comprises a hydraulic cylinder-and-piston unit extending from an abutment on the track to a swivel coupling on one end of a non-circular (e.g., square) section shaft slidable through a complementary guide hole in a central guide in the upright plate, the other end of the shaft being provided with a clamp for attachment to the core. Alternatively, each strand tensioning anchorage may comprise a hydraulic cylinder-and-piston unit extending towards the upright plate from a back plate to a swivel coupling on one end of a non-circular (e.g., square) section shaft slidable through a complementary guide hole in a rotatable guide in the upright plate, the other end of the shaft being provided with a clamp for attachment to the strand.

The abutment is preferably attachable at any of various positions along the track to suit various lengths of core, and the upright plate is mounted on a carriage movable along the track, as appropriate to strands matching the length of core, and, to allow for take-up on the lengths of the strands as they are wound helically round the core, a tensioning cylinder-and-piston unit is also operable between the carriage and the abutment.

The second drive means (for rotating the clamp at the leading end of the track) may be a motor with gearing for rotating the clamp; and the first drive means (for moving the trolley) may be gearing extending along the track from the motor for the clamp and engaging the trolley, or it may be winch at one end of the track winding a cable connected to the trolley, which cable may be endless so that the winch can wind it either way for movement of the trolley in either direction along the track, and the winch being driven (in one direction at least) at a predetermined ratio with the motor drive to the clamp at the leading end of the track.

It will be evident that a large number of the components of equipment according to the invention are inherently portable (i.e., the trolley and carriage). Therefore, in accordance with a further aspect of the invention, the track is formed of a plurality of modular units, each of a number of which preferably has its own set of support rollers, and the rotatable clamp and the abutment are each adapted to be secured respectively to an end unit of the track and another unit at a distance along the track.

Where sufficient multiple lengths of the same large rope product are required, rotating pay-off stands, e.g., seven, may be advantageously employed for the strands (or ropes) and the core, and be mounted beyond an end of the track, requisite lengths being pulled out without the need for cutting and applying terminal fittings, and the stands being rotated in synchronism with the tensioning anchorages.

Reference will now be made to the accompanying diagrammatic drawings, by way of example only of various aspects of the invention. In the drawings:

FIG. 1 is a cross-section of a stranded rope of large size formed by closing strands of appreciable overall diameter onto a core strand, as by means of the present invention;

FIG. 2 corresponds to FIG. 1 but shows a stranded rope of large size formed by closing ropes of appreciable overall diameter onto a core rope;

FIG. 3 (*a*), (*b*) and (*c*) are partsectional side elevations of successive portions of equipment in accordance with the invention;

Figures 3A, 3B, 3C:
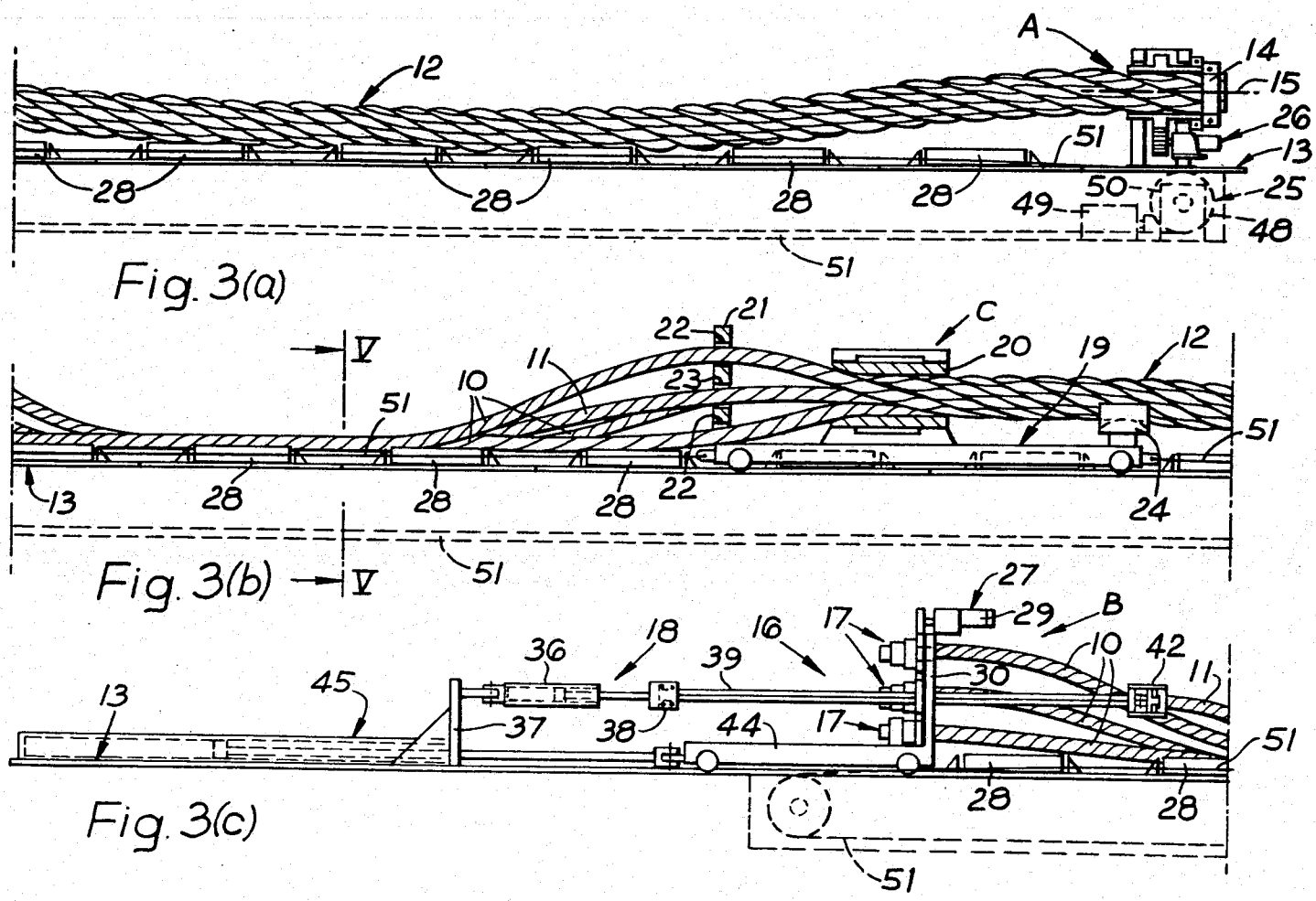
Figure 5:
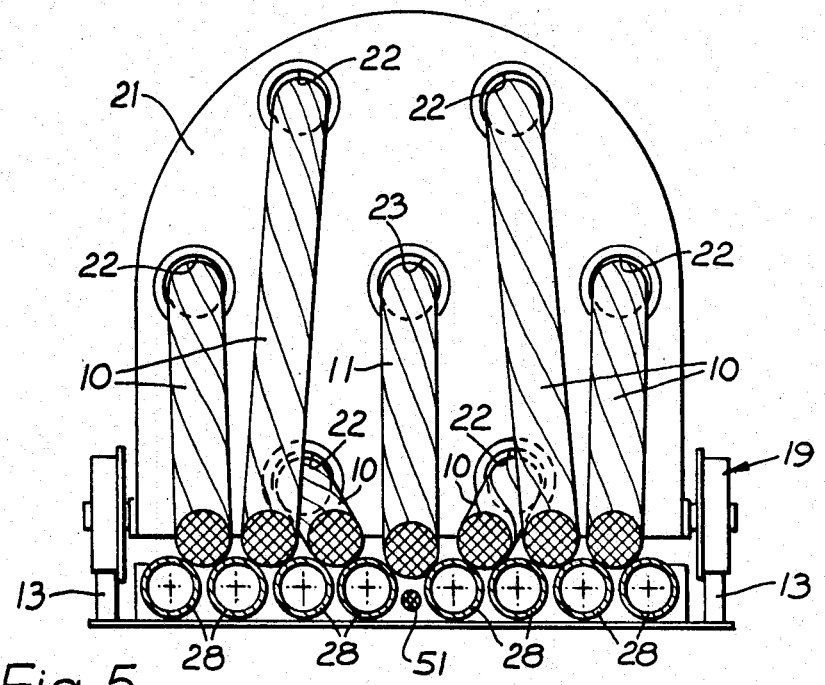
FIG. 5 is an enlarged part-section view taken from the line V—V of FIG. 3(*b*)
Figure 6:
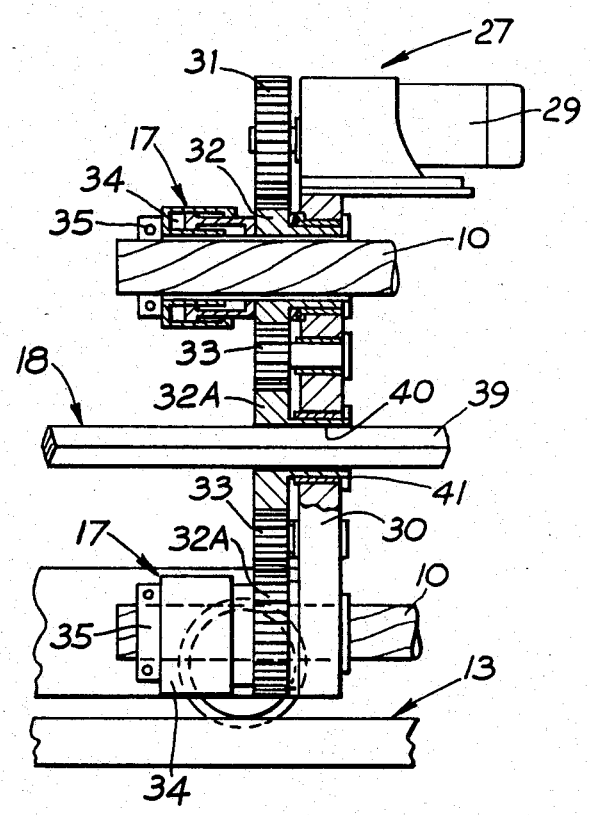
FIG. 6 is an enlargement of part of FIG. 3(*c*) towards the right-hand end.
Figure 7:
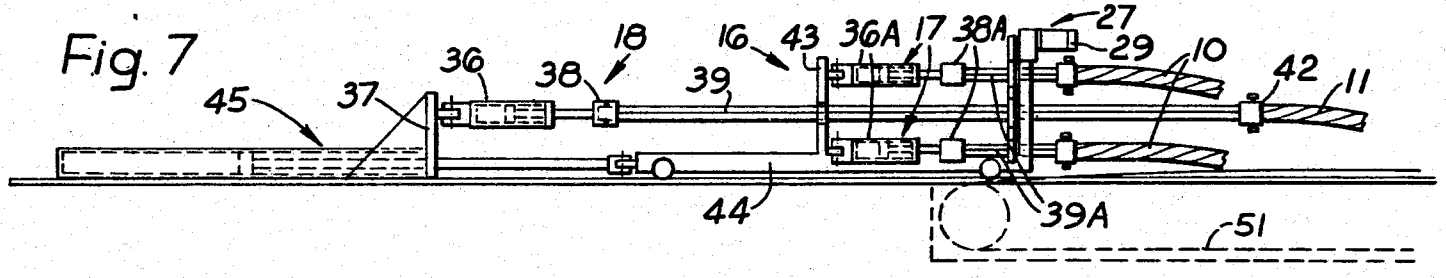

FIG. 7 corresponds to FIG. 3(*c*) but shows a modification; and

Figure 8:
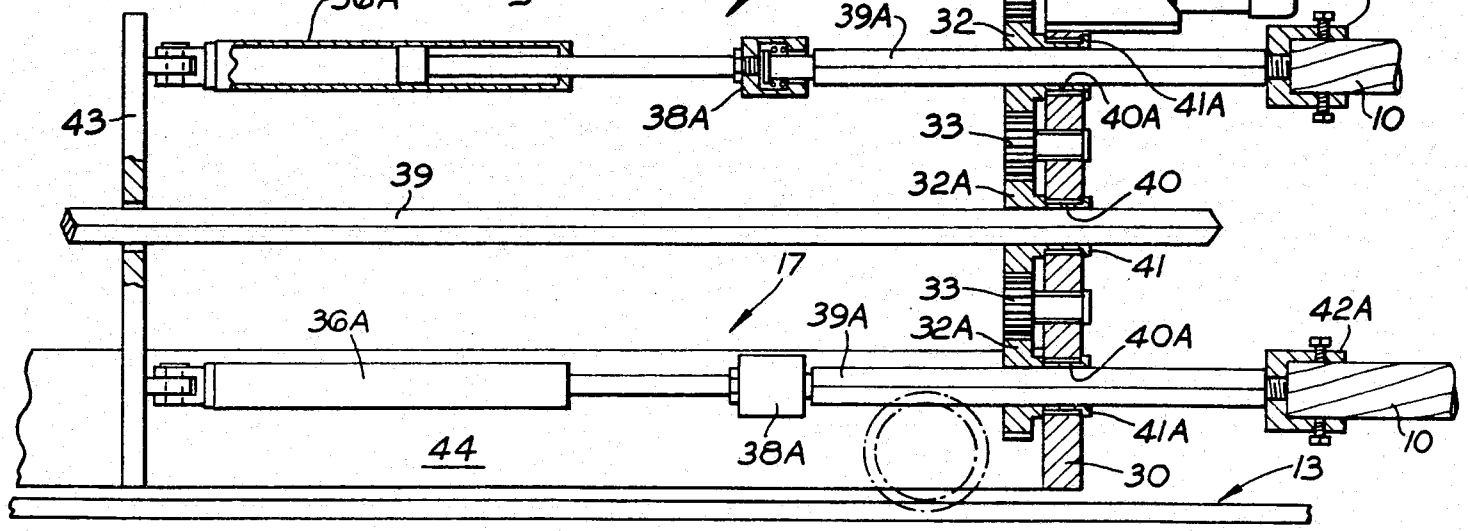

FIG. 8 is an enlargement of part of FIG. 7 towards the right-hand end.

Figure 1:
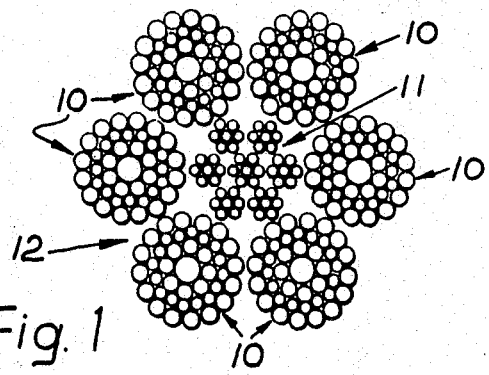
Figure 2:
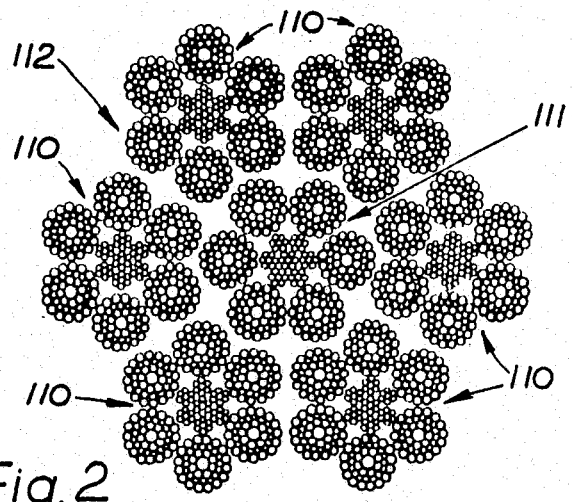
Figure 4:
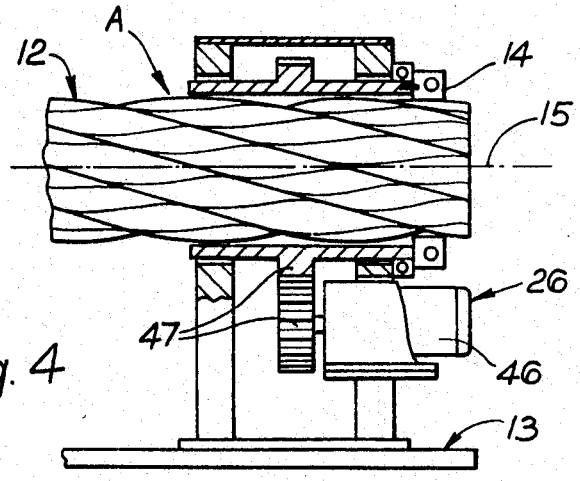
FIG. 4 is an elargement of part of the righ-hand end of FIG. 3(*a*)

In FIG. 1, six strands 10 are shown closed onto a core 11 to form a rope 12 of large size, as by the method and equipment to be described presently with reference to FIGS. 3 to 6, or as modified in FIGS. 7 and 8. It is equally possible to use the same method and equipment to form a rope 112, as shown in FIG. 2, of larger size by closing ropes 110 onto a core rope 111.

With reference to FIG. 3(*a*), (*b*) and (*c*), the method of the invention for making stranded ropes comprises assembling a plurality of strands 10 (which expression includes ropes 110) and a core 11 (or 111) side-by-side; securing all the strands and the core together at one, leading end A in the required closed rope array; securing all the strands and the core separately at the other trailing end B, spaced apart and rotatable; applying tension to all the strands and to the core; guiding the strands at C intermediate the ends into the closed rope array round the core; moving the aforesaid guiding progressively from the leading end A to the trailing end B; rotating the leading end progressively as the aforesaid guiding moves progressively; rotating the trailing ends of the strands and the core progressively in the same direction as the leading end; securing all the strands and the core together adjacent the trailing end; and releasing the trailing ends of the strands and the core and the tension applied thereto.

If necessary additional torque may be applied to the strands 10 and the core 11 by rotating their trailing end before rotation of the leading end commences. The trailing ends of the strands and the core may be rotated at a slightly different speed to the leading ends (either slightly faster or slightly slower), so as to maintain strand tightness and stability of the stranded rope 12.

The equipment shown in FIGS. 3 to 6 comprises an elongate track 13; a clamp 14 for securing a plurality of strands 10 (or ropes 110) and a core 11 (or 111) in the required closed array at the, leading end A of the track and rotatable about an axis 15 parallel to the track; anchor means 16 restrained at a distance along the track 13 from the clamp 14 and having rotatable tensioning spaced anchorages 17 for the trailing ends of the strands 10 extending along the track from the clamp, the anchor means 16 also having radially equidistant from the strand anchorages 17 a central rotatable tensioning anchorage 18 for the trailing end of the core 11 also extending along the track from the clamp; a trolley 19 movable along the track 13 between the clamp 14 and the anchor means 16 and carrying a forming die 20 for closing the strands 10 to the core 11 in the required closed rope array (at C), the forming die 20 being disposed between a lay plate 21 having strand guide apertures 22 (see FIG. 5) spaced radially equidistant from a core guide aperture 23, and a fairlead 24 for leading off the formed rope 12; first drive means 25 for moving the trolley 19 along the track 13; second drive means 26 for rotating the clamp 14 at the leading end A of the track with a predetermined relationship to movement of the trolley away from the leading end of the track; and third drive means 27 for rotating the trailing ends of the strands 10 and the core 11 progressively in the same direction as the clamp at the leading end.

The combination of tension in the strands 10 and/or the core 11, rotation of the clamp 14, and rotation of the trailing ends of the strands and the core enables the forming die 20 to form the rope 12 without undue stresses being induced as the forming die moves progressively with the trolley 19 along the track 13 away from the leading end A, the lay length of the strands 10 in the formed rope 12 being determined by the ratio of rotation of the clamp 14 to movement of the trolley 19 along the track 13.

Sets of rollers 28 are provided at intervals along the track 13, aligned with their axes parallel to the track, to support the strands 10 and core 11 between the anchor means 16 and the trolley 19 and to support the formed rope 12 between the trolley 19 and the clamp 14 at the leading end A of the track 13.

The third drive means 27 may be drivable at the same speed as the second drive means 26, to ensure no stresses are induced in the core 11, and the trailing ends of the strands 10 may be so drivable in relation to the trailing ends of the core 11 as to ensure no stresses are induced in the strands. Alternatively, the trailing ends of the strands and the core may be drivable at a slightly different speed from the clamp 14 (either slightly faster or slightly slower), so as to increase the tightness and stability of the stranded rope.

The third drive means 27 is a motor 29 mounted on top of an upright plate 30 of the anchor means 16, with a pinion 31 (FIG. 6) drivable by the motor 29 in mesh with a gear 32 rotatable with one of the strand anchorages 17, the other strand anchorages 17 and the central anchorage 18 for the core having similar gears 32A drivable through idler pinions 33 from the initially-driven gear 32.

Each strand tensioning anchorage 17 in FIGS. 3(*c*) and 6 comprises an annular cylinder-and-piston unit 34 for thrusting between the upright plate 30 and a clamp 35 on a strand extending through the units, and the core tensioning anchorage 18 comprises a hydraulic cylinder-and-piston unit 36 extending from an abutment 37 on the track to a swivel coupling 38 on one end of a non-circular (e.g., square) section shaft 39 slidable through a complementary guide hole 40 in a central guide 41 in the upright plate 30, the other end of the shaft 39 being provided with a clamp 42 for attachment to the core 11. Alternatively, as shown in FIGS. 7 and 8, each strand tensioning anchorage 17 may comprise a hydraulic cylinder-and-piston unit 36A extending towards the upright plate 30 from a back plate 43 to a swivel coupling 38A on one end of a non-circular (e.g., square) section shaft 39A slidable through a complementary guide hole 40A in a rotatable guide 41A in the upright plate, the other end of the shaft 39A being provided with a clamp 42A for attachment to the strand 10. The guides 41, 41A are integral with the respective gears 32, 32A.

The abutment 37 is attachable at any of various positions along the track 13 to suit various lengths of core 11, and the upright plate 30 is mounted on a carriage 44 movable along the track, as appropriate to strands 10 matching the length of core 11, and, to allow for take-up on the lengths of the strands 10 as they are wound helically round the core 11, a tensioning cylinder-and-piston unit 45 is also operable between the carriage 44 and the abutment 37.

The second drive means 26 for rotating the clamp 14 at the leading end A of the track 13 is a motor 46 (FIG. 4) with gearing 47 for rotating the clamp; and the first drive means 25 for moving the trolley 19 is a winch 48 at the leading end of the track, with a motor 49 and gearing 50, winding a cable 51 connected to the trolley 19, which cable 51 is endless so that the winch 48 can wind it either way for movement of the trolley 19 in either direction along the track 13, and the winch being driven (in one direction at least) at a pre-determined ratio with the drive 26 to the clamp 14 at the leading end A of the track.

The track is formed of a plurality of modular units, each of a number of which has its own set of support rollers, and the rotatable clamp and the abutment are each adapted to be secured respectively to an end unit of the track and another unit at a distance along the track.

What we claim is:

1. A method of making stranded ropes comprising assembling a plurality of strands and a core side-by-side; clamping all the strands and the core permanently together in a predetermined closed array at one, leading end; securing all the strands and the core separately at the other, trailing end; applying tension to each of the strands and to the core; progressively guiding the strands intermediate the ends into the closed array through guiding means; moving the aforesaid guiding means progressively from the leading end to the trailing end; rotating the leading end progressively as the aforesaid guiding means moves progressively and with a predetermined relationship; rotating the trailing ends of the strands and the core progressively in the same direction as the leading end and with a predetermined relationship; permanently securing all the strands and the core together adjacent the trailing end of the closed array; and releasing the trailing ends of the strands and the core and the tension applied thereto.

2. A method as in claim 1, wherein torque is applied to the trailing ends of all the strands and the core by rotating them before rotation of the leading end commences.

3. A method as in claim 1, wherein the trailing ends of the strands and/or the core are rotated at a different speed to the leading end, so as to increase the tightness and stability of the stranded rope.

4. Equipment for making stranded ropes comprising an elongate track; a clamp at one, leading end of the track for clamping a predetermined closed array of a plurality of strands and a core forming the rope, and said clamp being rotatable about an axis parallel to the track; anchor means restrained at a distance along the track from the clamp and having rotatable tensioning spaced anchorages for the trailing ends of the strands, which extend along the track from the clamp, the anchor means also having radially equidistant from the strand anchorages a central rotatable tensioning anchorage for the trailing end of the core, which also extends along the track from the clamp; a trolley movable along the track between the clamp and the anchor means; a forming die carried by the trolley for progressively closing the strands to the core in the predetermined closed rope array; a lay plate carried by the trolley and having strand guide apertures spaced radially equidistant from a core guide aperture; first drive means for moving the trolley along the track from the leading end; second drive means for rotating the clamp at the leading end of the track with a predetermined relationship to movement of the trolley; and third drive means for rotating the trailing ends of the strands and the core progressively in the same direction as the clamp at the leading end and with a predetermined relationship.

5. Equipment as in claim 4, wherein sets of rollers are provided at intervals along the track, aligned with their axes parallel to the track, to support the strands and the core between the anchor means and the trolley and to support the formed rope between the trolley and the clamp at the leading end of the track.

6. Equipment as in claim 4, wherein the anchor means comprises an upright plate, a motor forming the third drive means being mounted on top of the upright plate, a pinion drivable by the motor, a gear in mesh with the pinion and rotatable with one of the strand anchorages, similar gears for the other strand anchorages and the central anchorage for the core, and idler pinions for driving those gears from the initially-driven gear.

7. Equipment as in claim 6, wherein each strand tensioning anchorage comprises a clamp on the trailing end of each strand, an annular cylinder-and-piston unit for thrusting between the upright plate and the clamp, with the strand extending through the unit; and wherein the core tensioning anchorage comprises an abutment on the track, a non-circular section shaft slidable through a complementary guide hole in the central guide, a swivel coupling on the one end of the shaft, a hydraulic cylinder-and-piston unit extending from the abutment to the swivel coupling, and a clamp on the other end of the shaft for attachment to the core.

8. Equipment as in claim 6, wherein a back plate is provided towards the trailing end of the track, and each strand tensioning anchorage comprises a rotatable guide in the upright plate, a non-circular section shaft slidable through a complementary guide hole in the rotatable guide in the upright plate, a swivel coupling on the end of the shaft, a hydraulic cylinderand-piston unit extending towards the upright plate from the back plate to the swivel coupling, the other end of the shaft being provided with a clamp for attachment to the stand; and wherein the core tensioning anchorage comprises an abutment on the track, a non-circular section shaft slidable through a complementary guide hole in the central guide, a swivel coupling on one end of one shaft, a hydraulic cylinder-and-piston unit extending from the abutment on the track to the swivel coupling and a clamp on the other end of the shaft for attachment to the core.

9. Equipment as in claim 6, wherein the abutment is attachable at any of various positions along the track to suit various lengths of core, and the upright plate is mounted on a carriage movable along the track, as appropriate to strands matching the length of core, and, to allow for take-up on the lengths of the strands as they are wound helically round the core, a tensioning cylinder-and-piston unit is also operable between the carriage and the abutment.

10. Equipment as in claim 4, wherein the second drive means is a motor with gearing for rotating the clamp.

11. Equipment as in claim 10, wherein an endless cable is connected to the trolley, and the first drive means is a winch at one end of the track for winding the cable, the winch being driven in one direction at least at a predetermined ratio with the motor drive to the clamp at the leading end of the track.

12. Equipment as in claim 4, wherein the track is formed of a plurality of modular units, sets of support rollers are provided on each of a number of the units, and the rotatable clamp and the abutment are each adapted to be secured respectively to the unit at the leading end of the track and to another unit at a distance along the track.

13. Equipment as in claim 4, further including a fairlead carried by the trolley for leading off the form rope, and said forming die being disposed between the lay plate and the fairlead.

* * * * *